US005688060A

United States Patent [19]

Terao

[11] Patent Number: 5,688,060

[45] Date of Patent: Nov. 18, 1997

[54] THERMAL TRANSFER PRINTER

[75] Inventor: Hirotoshi Terao, Iwate-ken, Japan

[73] Assignee: Alps Electric Co., Ltd., Tokyo, Japan

[21] Appl. No.: 635,127

[22] Filed: Apr. 19, 1996

[30] Foreign Application Priority Data

Apr. 25, 1995 [JP] Japan ..... 7-101189

[51] Int. Cl.[6] ..... B41F 35/00

[52] U.S. Cl. ..... 400/701; 400/702; 347/171

[58] Field of Search ..... 101/423, 425; 400/701, 702; 347/22, 26, 171

[56] References Cited

U.S. PATENT DOCUMENTS

| | | | |
|---|---|---|---|
| 4,621,274 | 11/1986 | Yuasa | 346/153.1 |
| 5,126,765 | 6/1992 | Nakamura | 346/140 |
| 5,202,702 | 4/1993 | Terasawa et al. | 346/1.1 |

FOREIGN PATENT DOCUMENTS

| | | | |
|---|---|---|---|
| 58-7378 | 1/1983 | Japan . | |
| 1-174481 A | 12/1987 | Japan | 400/701 |
| 2-89673 A | 3/1990 | Japan | 400/701 |
| 2-122969 A | 5/1990 | Japan | 400/701 |
| 4-216087 A | 8/1992 | Japan | 400/701 |
| 1057306 A | 11/1983 | U.S.S.R. | 101/423 |

*Primary Examiner*—Edgar S. Burr
*Assistant Examiner*—Dave A. Ghatt
*Attorney, Agent, or Firm*—Guy W. Shoup; Patrick T. Bever

[57] ABSTRACT

A thermal transfer printer in which when a printing head is soiled, the debris on the printing head can be removed automatically. The printing head movable to and from a platen is mounted on a carriage capable of being reciprocated along the platen, and a cleaning pad is disposed on an extension line of the platen downsteam or upstream in the printing column direction of the platen.

1 Claim, 4 Drawing Sheets

THERMAL TRANSFER PRINTER

BACKGROUND OF THE INVENTION

1. Field of the Invention

The present invention relates to a thermal transfer printer and a thermal head cleaning method in the thermal transfer printer. Particularly, the present invention relates to a thermal transfer printer in which when the thermal head is soiled, the accumulated debris on the thermal head can be removed automatically.

2. Description of the Related Art

Thermal transfer printers have been often used heretofore, in which heat generating elements formed on a thermal head are electrified whereby the heat generating elements generate heat which melts ink of an ink ribbon, causing the melted ink to transfer to paper so that a desired printing is effected.

FIGS. 4 and 5 show a conventional general thermal transfer printer, in which a flat plate-like platen 2 is disposed. The platen 2 includes a printing surface which is substantially vertical and is in a substantially central portion of a frame 1 of the printer, and a carriage shaft 3 is disposed parallel with the platen 2, and is in front of and below the platen 2. The frame 1 is formed at its front end edge with a flange-like guide portion 4, and in the carriage shaft 3 and the guide portion 4, a carriage 5 is mounted so as to be reciprocated along the carriage shaft 3 and the guide portion 4.

A thermal head 7 that can be moved to and from the platen 2 by the operation of a head lever 6 is mounted at the extreme end of the carriage 5. On the upper surface of the carriage 5 is mounted a ribbon cassette (not shown) which receives an ink ribbon to guide the ink ribbon between the thermal head 7 and the platen 2. Further, on the upper surface of the carriage 5 are disposed a winding bobbin 8 for winding an ink ribbon of the ribbon cassette and a delivery bobbin 9 for delivering the ink ribbon.

Further, a paper inserting opening 11 for feeding a sheet of paper 10 toward the front of the platen 2 is formed at the rear of the platen 2, and paper feed rollers 12 for carrying the paper at a predetermined speed are disposed at portions of the paper inserting opening 11. Below each of the paper feed rollers 12 is rotatably disposed a pressure roller 13 pressed against the paper feed roller 12, and on one side of the frame is disposed a paper feed motor 15 for rotating the paper feed rollers 12 through a group of transmission gears 14. The paper feed motor 15 is driven to rotate the paper feed rollers 12 whereby the paper 10 inserted between the paper feed rollers 12 and the pressure rollers 13 from the paper inserting opening 11 is held and fed.

In the above-described conventional printer, the paper 10 is inserted from the paper inserting opening 11, the paper 10 is held between the paper feed rollers 12 and the pressure rollers 13, and the paper feed rollers 12 are rotated by the paper feed motor 15 whereby the paper 10 is fed at a predetermined speed in the direction perpendicular to the moving direction of the carriage 5. On the other hand, the thermal head 7 is placed in pressure contact with the paper 10 by a predetermined pressing force, in which state the carriage 5 is moved and the winding bobbin 8 is rotated to wind the ink ribbon of the ribbon cassette and at the same time the thermal head 7 is driven according to a desired printing signal to impart a desired printing to the paper 10.

However, in the above-described conventional thermal transfer printer, the printing is carried out while travelling the ink ribbon in the state where the thermal head 7 is pressed against the back of the ink ribbon. Therefore, there poses a problem in that when printing is carried out many times, a part of the back of the ink ribbon is peeled off due to the friction caused by sliding with the thermal head 7, and as a result, debris 16 produced by the peeling-off of the ink ribbon becomes adhered to and accumulated on the downstream side in the travelling direction of the ink ribbon at a heat generating portion of the thermal head 7, thereby soiling the thermal head 7, as shown in FIGS. 6 and 7.

Further, in a thermal transfer printer capable of performing a full color printing, for example, a predetermined one line portion is printed with a predetermined first color on the paper 10, and after this, printing is repeated on the paper 10 through the one line portion using second and third colors. Such an operation as just described is performed for each color to thereby perform a desired full color printing. In this case, when printings of different colors are performed for one printing line, the feeding operation and returning operation of the paper 10 are repeated. Therefore, there involves a problem in that as shown in FIG. 5, ink 17 of a color already printed is peeled off due to the friction caused by sliding and adhered as debris 16 to the downstream side in the feeding direction of the paper 10 of the thermal head 7, and soiling of the thermal head 7 likewise occurs.

In such a case, in the past, the thermal head 7 is cleaned periodically by hand. However, this operation is cumbersome. Further, in a case where one fails to perform the cleaning, there poses a problem in that the inferior operation of the thermal head 7 results, and the debris becomes adhered to the paper 10, resulting in undesirable discoloration on the paper 10.

SUMMARY OF THE INVENTION

The present invention has been accomplished in view of the aforementioned inconveniences. An object of the present invention is to provide a thermal transfer printer in which when a thermal head is soiled, the debris on the thermal head can be removed automatically.

It is a further object of the present invention to provide a thermal transfer printer in which on a carriage capable of being reciprocated along a platen is mounted a thermal head capable of being moved to and from the platen through an ink ribbon and a sheet of paper, wherein a cleaning pad is disposed at least upstream or downstream in the printing column direction on an extension line of the platen in a state where the thermal head is movable in pressure contact with the cleaning pad.

It is another object of the present invention to provide a thermal transfer printer in which the cleaning pad is formed with a groove which extends in the vertical direction.

It is still another object of the present invention to provide a thermal transfer printer in which a solution containing a polishing agent is contained in the cleaning pad.

It is another object of the present invention to provide a thermal transfer printer in which when the thermal head is moved while placed in pressure contact with the cleaning pad, control is made so that the thermal head is electrified.

It is further another object of the present invention to provide a thermal transfer printer in which when the number of printing operations reaches a preset number, a carriage is moved with a ribbon cassette removed therefrom to move a thermal head to a cleaning pad portion whereby the thermal head is made head down into pressure contact with the cleaning pad, and at this state the carriage is reciprocated to slide the thermal head against the cleaning pad thereby removing the debris adhered to the thermal head.

DESCRIPTION OF THE PREFERRED EMBODIMENT

The embodiment of the present invention will be described hereinafter with reference to FIGS. 1 to 3.

Figure 1:
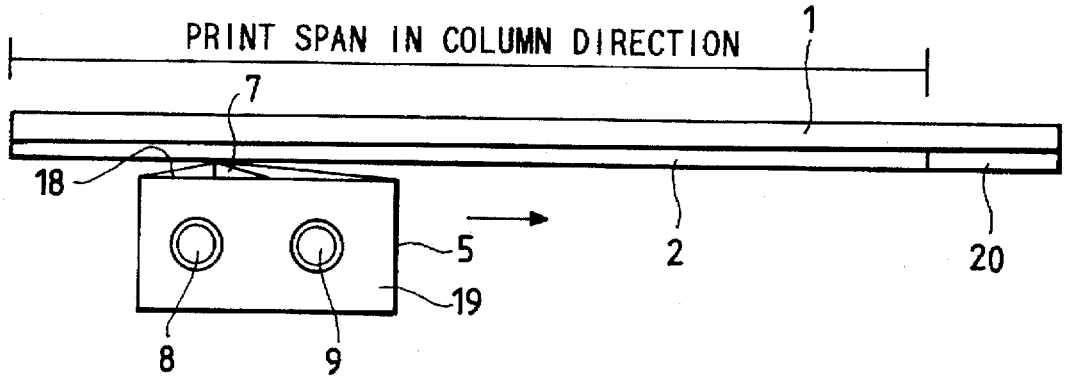
FIG. 1 is a plan view of a platen portion showing an embodiment of a thermal transfer printer according to the present invention.
Figure 2:
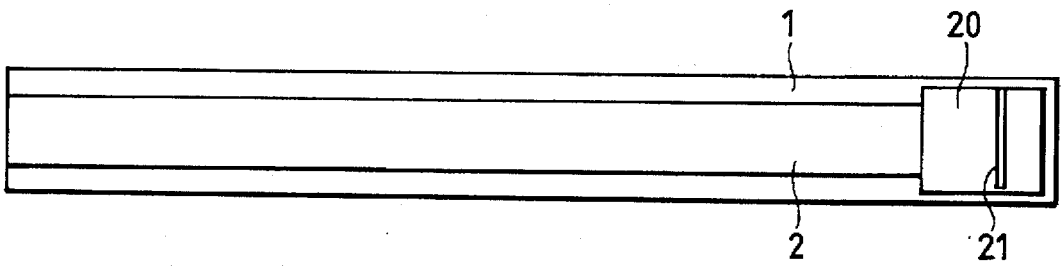
FIG. 2 is a front view of the platen portion showing the embodiment of the thermal transfer printer according to the present invention.

FIGS. 1 and 2 show one embodiment of a thermal transfer printer according to the present invention. In a substantially central portion of a frame 1 of the printer, there is disposed a flat plate-like platen 2 having a substantially vertical printing surface. On the front side of the platen 2, there is mounted a carriage 5 capable of being reciprocated along the platen 2. A thermal head 7 is mounted at the extreme end of the carriage 5 so as to be opposite to the platen 2, and a ribbon cassette 19 for receiving an ink ribbon 18 and guiding the ink ribbon 18 between the thermal head 7 and the platen 2 is mounted on the upper surface of the carriage 5. Further, a winding bobbin 8 for winding the ink ribbon 18 in the ribbon cassette 19 and a delivery bobbin 9 for delivering the ink ribbon 18 are disposed on the upper surface of the carriage 5.

In the present embodiment, a cleaning pad 20 is disposed to form a continuous surface with the substantially vertical surface of the platen 2 downstream in the printing column direction of the platen 2. The cleaning pad 20 is formed so as to be longer in dimension than the platen 2 in the vertical direction. The surface of the cleaning pad 20 is formed at a substantially even height with respect to the surface of the platen 2, and a vertically extending groove 21 is formed in a substantially central portion of the cleaning pad 20. It is to be noted that instead of the groove 21, a difference in level may be formed. Further, the cleaning pad 20 may be formed of a material, for example, cloth such as felt and gauze, paper such as tissue, and cotton wool, or a brush may be formed on the surface thereof. Further, the cleaning pad 20 may be of a dry type or a wet type. In the wet type, the cleaning pad 20 is permeated with a volatile solution such as alcohol, acetone and toluene, or a solution containing polishing particles such as $SiO_2$ and $CaCO_2$.

The operation of the present invention will now be described below.

First, in the present embodiment, a desired printing is performed in the following procedure. The thermal head 7 is placed in pressure contact with the platen 2 (so-called head down state). In this state, the carriage 5 is moved and the winding bobbin 8 is rotated to wind the ink ribbon 18, during which heat generating elements of the thermal head 7 are selectively generate heat on the basis of a predetermined printing signal to apply the desired printing to a predetermined sheet of paper not shown.

Figure 3:
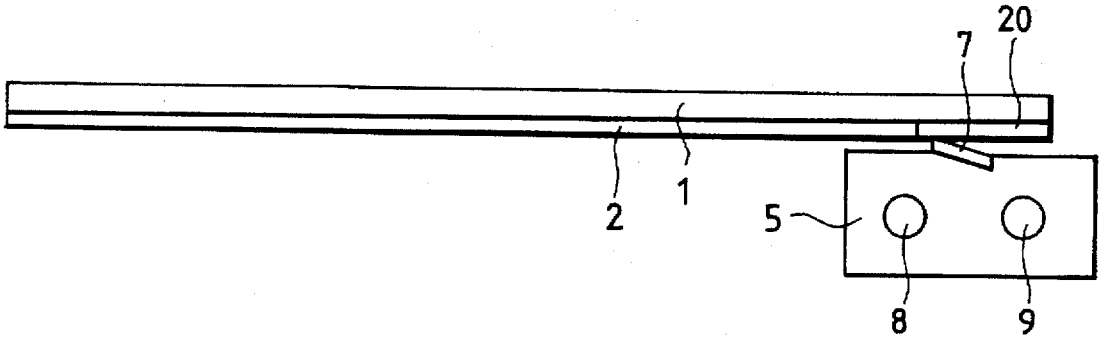
FIG. 3 is a plan view of the platen portion showing the operating state of cleaning a thermal head of the thermal transfer printer according to the present invention.
Figure 4:
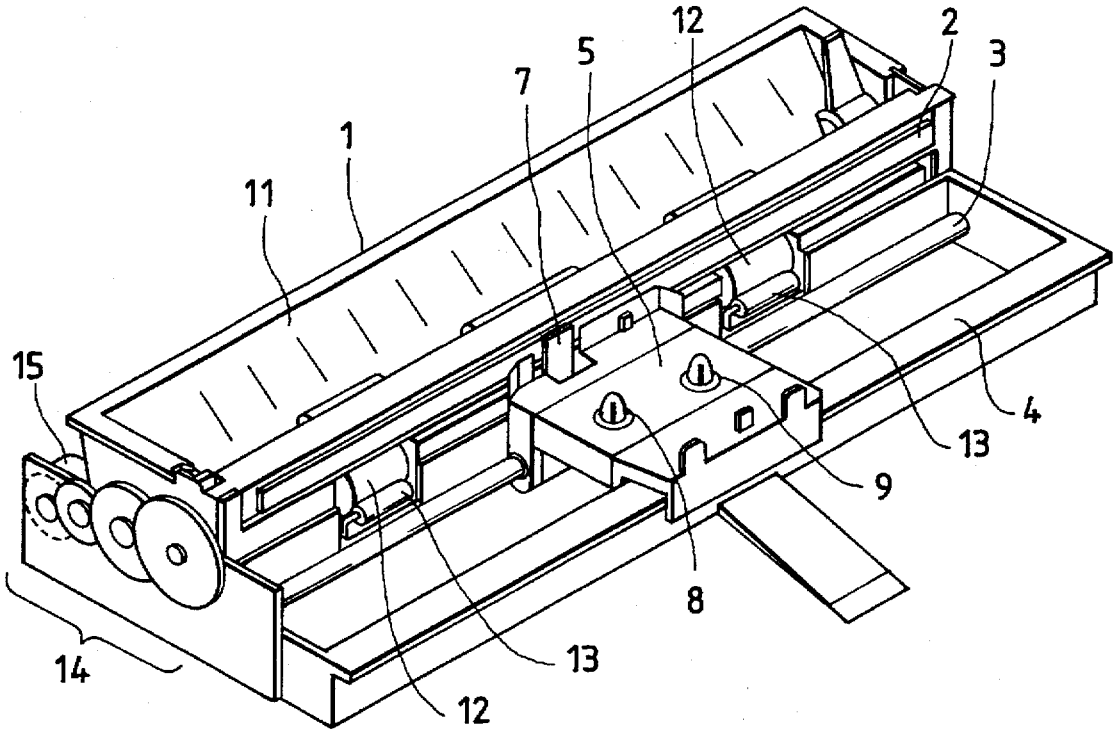
FIG. 4 is a perspective view showing the construction of essential parts of a conventional thermal transfer printer.
Figure 5:
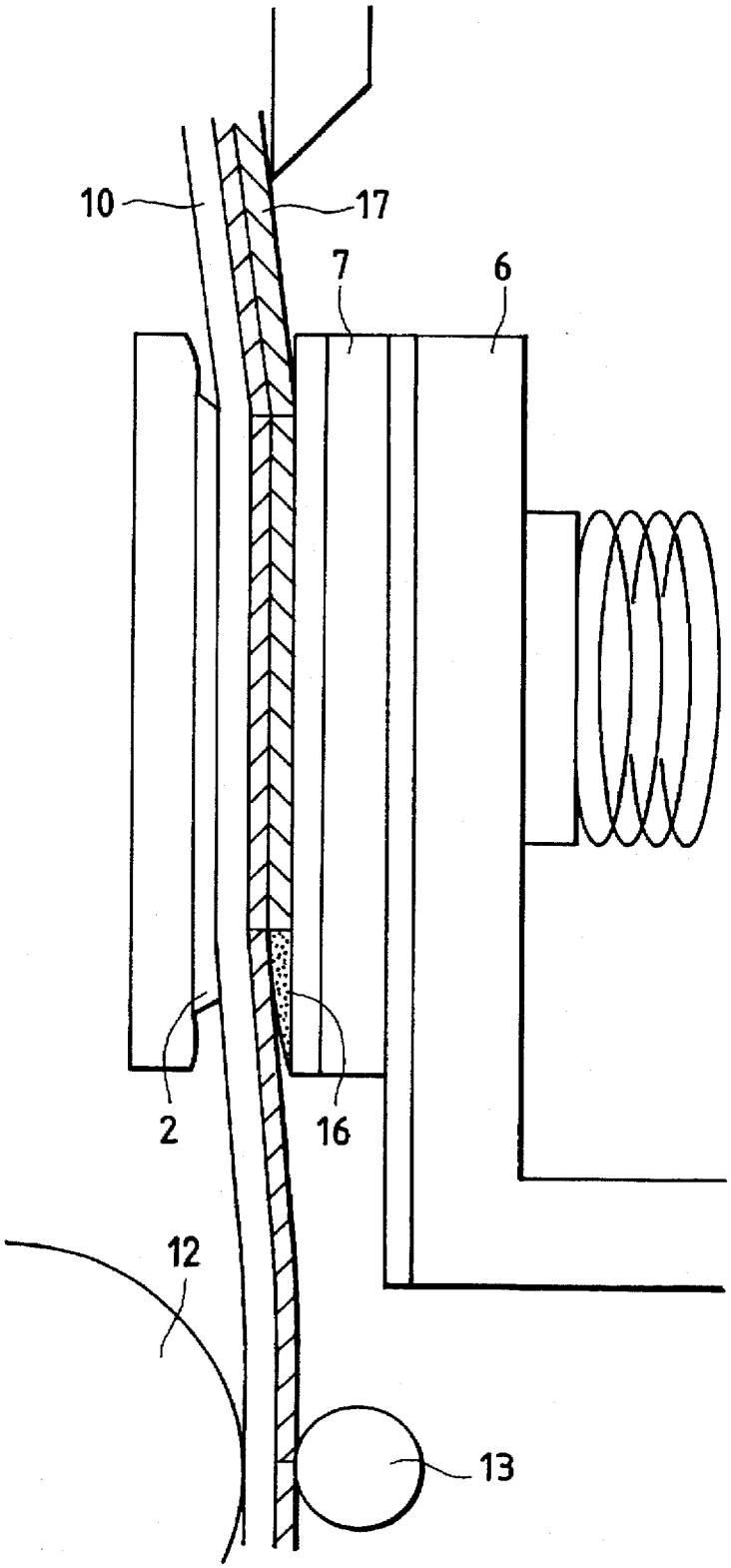
FIG. 5 is an enlarged side view of a thermal head portion of the thermal transfer printer.
Figure 6:
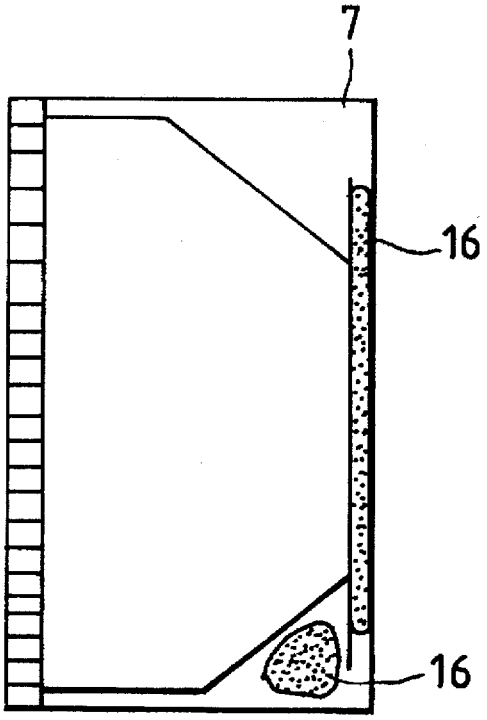
FIG. 6 is an explanatory view showing a soiled state of the thermal head in the conventional thermal transfer printer.
Figure 7:
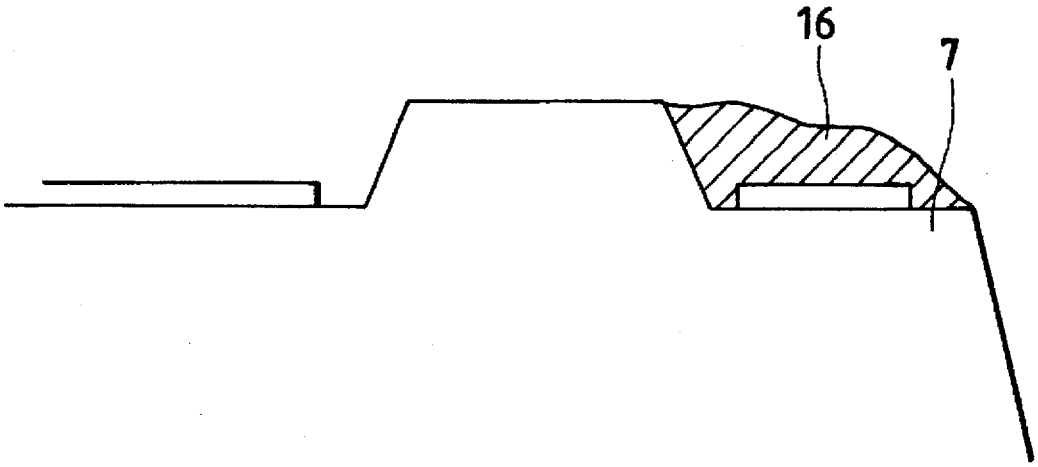
FIG. 7 is an enlarged sectional view of the thermal head shown in FIG. 6.

When the number of printed letters reaches that suitably preset, the ribbon cassette 19 is removed from the carriage 5, as shown in FIG. 3, under which state the carriage 5 is moved to move the thermal head 7 to the cleaning pad 20. Subsequently, the thermal head 7 is made head down to place the printing surface of the thermal head 7 in pressure contact with the cleaning pad 20. In this state, the carriage 5 is reciprocated to thereby slide the thermal head 7 with respect to the cleaning pad 20. Thereby, the debris adhered to the thermal head 7 is removed with the aid of friction produced when the thermal head 7 is slidably moved with respect to the cleaning pad 20. The above-described operation is performed in a manner such that for example, a cleaning sequence is set in advance to a control unit of the printer, and a cleaning switch is operated to thereby automatically control the cleaning operation.

In this case, since in the present embodiment, the cleaning pad 20 is formed with the groove 21, the debris can be efficiently removed from the thermal head 7 by the presence of the groove 21.

In the above-described cleaning operation, it is necessary to manually remove the ribbon cassette 19 from the carriage 5. However, in a printer provided with a cassette exchange mechanism for automatically exchanging the ribbon cassette 19, when a cleaning switch is operated to perform the cleaning operation, the control can be made so that the ribbon cassette 19 is automatically removed.

Further, in the cleaning operation, for efficiently removing the debris adhered to the thermal head 7, the thermal head 7 is placed in pressure contact with the cleaning pad 20, under which state the thermal head 7 is electrified to melt the debris adhered to the thermal head 7 during which the thermal head 7 is slidably moved with respect to the cleaning pad 20.

Accordingly, in the present embodiment, the debris on the thermal head 7 can be easily and positively removed merely by arranging the cleaning pad 20 downstream in the printing column direction of the platen 2 and actuating the carriage 5 to slide the thermal head 7 with respect to the cleaning pad. As a result, it is possible to prevent an occurrence of print discoloration caused by the debris on the thermal head 7 to provide a printing of high quality.

While in the above-described embodiment, the cleaning pad 20 is disposed downstream at the platen 2, it is to be noted that the cleaning pad 20 may be upstream at the platen 2 to clean the thermal head prior to starting of printing, by which a similar effect may be obtained.

Further, while in the above-described embodiment, the thermal head 7 is slidably moved with respect to the cleaning pad 20 to effect cleaning, it is to be noted that without being provided with the cleaning pad 20, the thermal head 7 is merely slidably moved to a sheet of paper positioned on the platen 2 to obtain the cleaning effect. Further, in this case, the thermal head 7 is electrified to enhance the cleaning effect.

Further, the present invention is not limited to the aforementioned embodiment but various changes and modifications can be made as necessary.

What is claimed is:

1. A thermal transfer printer comprising:

a carriage capable of being reciprocated along a platen;

a thermal head mounted on said carriage, the thermal head including a plurality of heat generating elements; and a ribbon cassette detachably mounted on said carriage, the ribbon cassette housing an ink ribbon;

wherein said heat generating elements are selectively driven while said carriage reciprocates along said platen in a state where said thermal head is placed in pressure contact with the platen through said ink ribbon and a sheet of paper to perform a printing on said paper, wherein a cleaning pad is disposed at least at a downstream end or an upstream end of said platen and forming a continuous surface with said platen such that said thermal head is movable from the platen into pressure contact with the cleaning pad, wherein said cleaning pad is formed with a planar surface which contacts said thermal head, and wherein said thermal transfer printer further comprises means for electrifying said thermal head while the thermal head is in pressure contact with said cleaning pad.

* * * * *